US006071192A

United States Patent [19]

Weiss

[11] Patent Number: 6,071,192

[45] Date of Patent: Jun. 6, 2000

[54] GAMING MACHINE DISPLAY SIMULATION OF MINTING COINS

[75] Inventor: Steven A. Weiss, Las Vegas, Nev.

[73] Assignee: Casino Data Systems, Las Vegas, Nev.

[21] Appl. No.: 08/858,471

[22] Filed: May 20, 1997

[51] Int. Cl.[7] ..... A63F 9/22

[52] U.S. Cl. ..... 463/31; 463/20; 273/143 R

[58] Field of Search ..... 273/143 R; 463/31, 463/20, 13, 12

[56] References Cited

U.S. PATENT DOCUMENTS

| | | | |
|---|---|---|---|
| 4,553,748 | 11/1985 | Allen et al. . | |
| 5,127,151 | 7/1992 | Okada | 273/143 R |
| 5,393,061 | 2/1995 | Manship et al. | 273/143 R |
| 5,449,173 | 9/1995 | Thomas et al. | 273/143 R |
| 5,472,195 | 12/1995 | Takemoto et al. | 273/143 R X |
| 5,494,287 | 2/1996 | Massy | 273/143 R |
| 5,560,603 | 10/1996 | Seelig et al. | 273/143 R X |

OTHER PUBLICATIONS

Macaulay, David, The New Way Things Work© 1988, 1998 pp. 214–215 which depicts a graphical animation of a printing press operation.

Atronic Casino Technology brochure, 1995.

*Primary Examiner*—Michael O'Neill
*Attorney, Agent, or Firm*—Bernhard Kreten

[57] ABSTRACT

A gaming machine display, apparatus and method in which a simulation of minting coins is provided on a video monitor of a gaming machine coupled to a processor which simulates a plurality of balls extending down a trackway, a simulated minting machine on the display oriented to receive the balls and simulated coins exiting the machine as a function of player performance. The player performance, should it reach a grand prize level causes the minting station to break via simulation and the appearance of a caricature announces that an attendant will come by for resetting the machine for hand payout.

5 Claims, 4 Drawing Sheets

GAMING MACHINE DISPLAY SIMULATION OF MINTING COINS

FIELD OF THE INVENTION

The following invention relates to gaming machines used in a casino environment. More particularly, the instant invention relates to a display simulation, apparatus and method of play therefore.

BACKGROUND OF THE INVENTION

The odyssey for games which consume a player's attention and stimulation is ongoing. The following invention reflects further efforts by applicant in this area.

Most gaming machines involve static displays. These displays are typically found on exposed glass surfaces of a machine and are static. However, with the advent of video display monitors, it is now possible to provide a dynamic simulation on the video display which has thematic correlation to the underlying game.

SUMMARY OF THE INVENTION

The instant invention includes a video simulation on a monitor encased within a gaming machine. The simulation involves graphics which simulate a series of balls rolling down a trackway as a function of player performance on a reel-type of gaming device. When an award is due a player, the balls are advanced into an inlet hopper on a minting station having an output. The output simulates minted coins dropping from the minting station and these coins signify an award having been credited to the player. Should the player achieve an outcome that warrants an extremely large payout, such a payout is typically made by an attendant to the machines manually. Accordingly, the video simulation includes a series of balls going into the feed hopper of the minting station coupled with a simulated breakdown of the minting machine in conjunction with the appearance of an icon evocative of an animated figure that explains to the player that a hand or manual payout will ensue. Certain indicia such as alarms or other audio output accompany the breaking of the machine providing excitement for the player until an attendant arrives at the machine for the manual, hand payout whereupon the prospective award is verified with respect to the propriety of making such an award, coupled with any manual payout and resetting the machine.

OBJECTS OF THE INVENTION

Accordingly, it is a primary object of the present invention to provide a new, novel and useful game machine display simulation and methodology therefore.

A further object of the present invention is to provide a display, apparatus and methodology as set forth hereinabove which enhances player satisfaction and stimulation.

Viewed from a first vantage point, it is an object of the present invention to provide a display simulation and gaming machine, comprising, in combination: a video display coupled to a processor including means to simulate a plurality of balls down a trackway, a simulated minting station on the display oriented to receive the balls, simulated coins exiting the minting station as a function of player performance, and means to increment credits to the player.

Viewed from a second vantage point, it is an object of the present invention to provide a method for stimulating a player via a display monitor of a gaming machine, the steps including: displaying balls rolling into a hopper of a minting station and displaying coins exiting the minting station as a function of player performance, and crediting the player with an award.

These and other objects will be made manifest when considering the following detailed specification when taken in conjunction with the appended drawing figures.

DESCRIPTION OF PREFERRED EMBODIMENTS

Figure 1A:
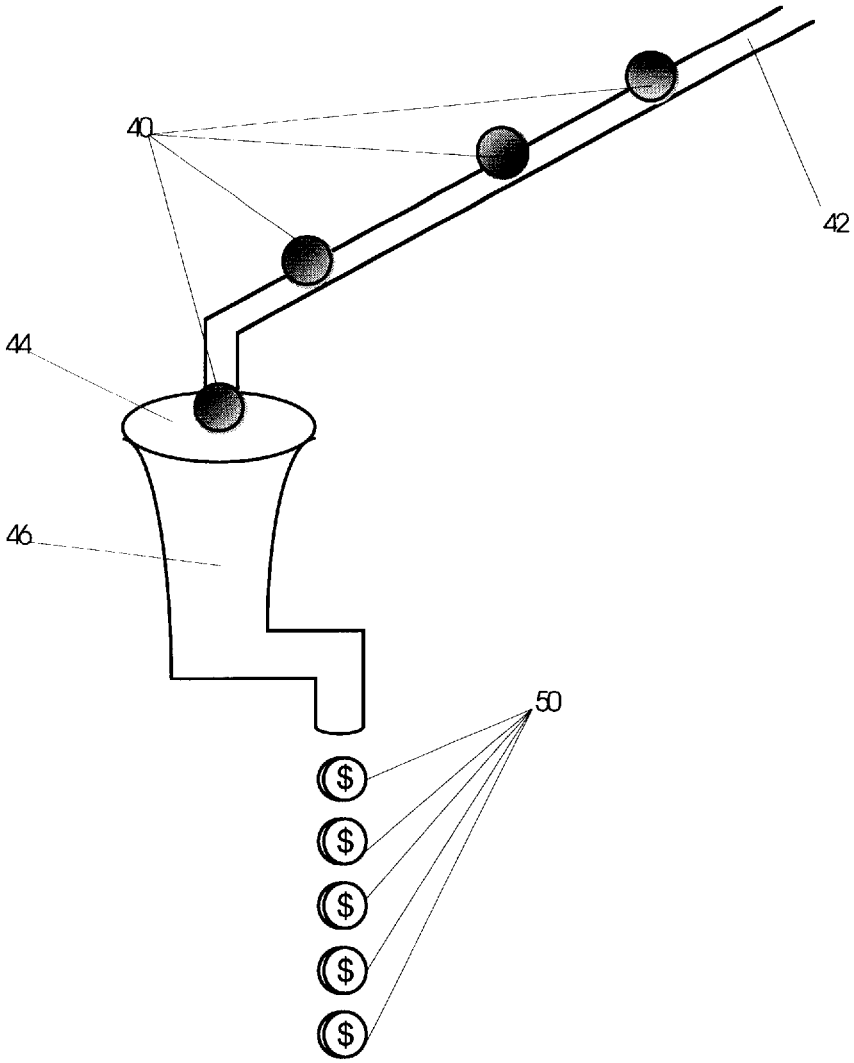
FIG. 1A reflects a display on the screen of the game in progress in which the player has been awarded a payout.
Figure 1A:
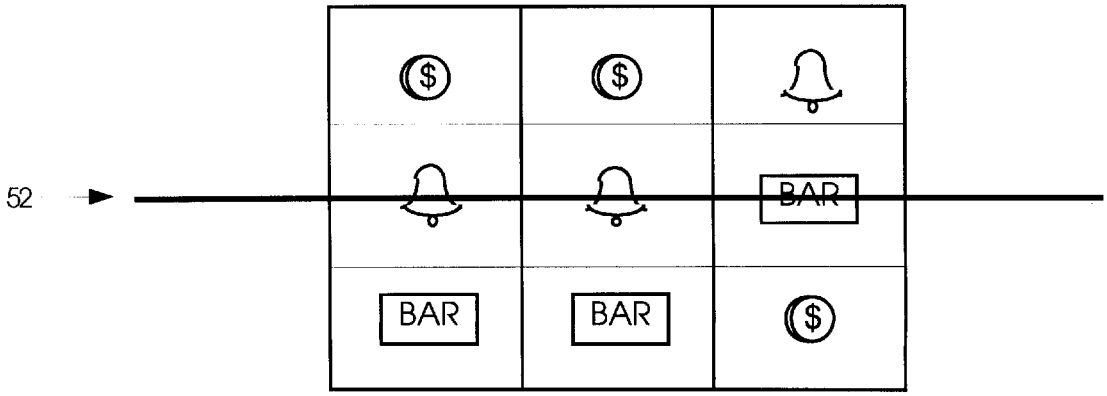

Considering the drawings, wherein like reference numerals denote like parts throughout the various drawing figures, reference numeral 10 is directed to the machine according to the present invention.

As shown, the machine 10 includes a housing 16 which supports a video monitor 2 therewithin. The monitor may include a window 8 for special messages or for incremental counting of credits accumulated by the player. The machine 10 also includes an LED readout 4 for prompting the player and providing verbiage to stimulate the player as shown by LED readout 4 and an inlet 6 for the reception therein of coins, currency or the like to auger in the inception of play. A plurality of decision making buttons 12 are located on a face of the machine 10 preferably below the display 2 and a pull handle 14 can be used to initiate play as an alternative or supplement to the decision making buttons 12. A plurality of speakers 34 may be included on the machine for aural interaction with the player. A coin hopper 18 may be included to effectuate an output of an award due the player. The machine may have a top portion 32 with a display thereon having a static motif correlative with the game to be played.

Referring to FIG. 1A, a series of balls 40 are adapted to roll down a trackway 42 into a hopper 44 of a minting station or machine 46. The minting machine 46 includes an outlet 48 from which descends a plurality of coins 50 simulative of the player having been awarded an output correlative with a payout. A lower portion of the screen, also as shown in FIG. 1A, illustrates a reel-type machine in which a payoff may be due by virtue of "two bells" and a "bar" arrangement that correlates to a payout according to a paytable posted on the machine (not shown). Note that FIG. 1A also includes the provision of three coins not located on the payline 52, but visible. Should these three coins be on the payline 52, FIG. 1B will show the result. In this event, a caricature appears on the screen that is accompanied with the minting station 46 having been broken by the player having achieved the grand prize. The caricature can then enable speakers 34 on the machine 10 to announce that an attendant will come by for a hand pay or in the alternative, and/or in conjunction, a visual depiction of the attendant will appear which announces that you will be paid on the display.

Figure 1B:
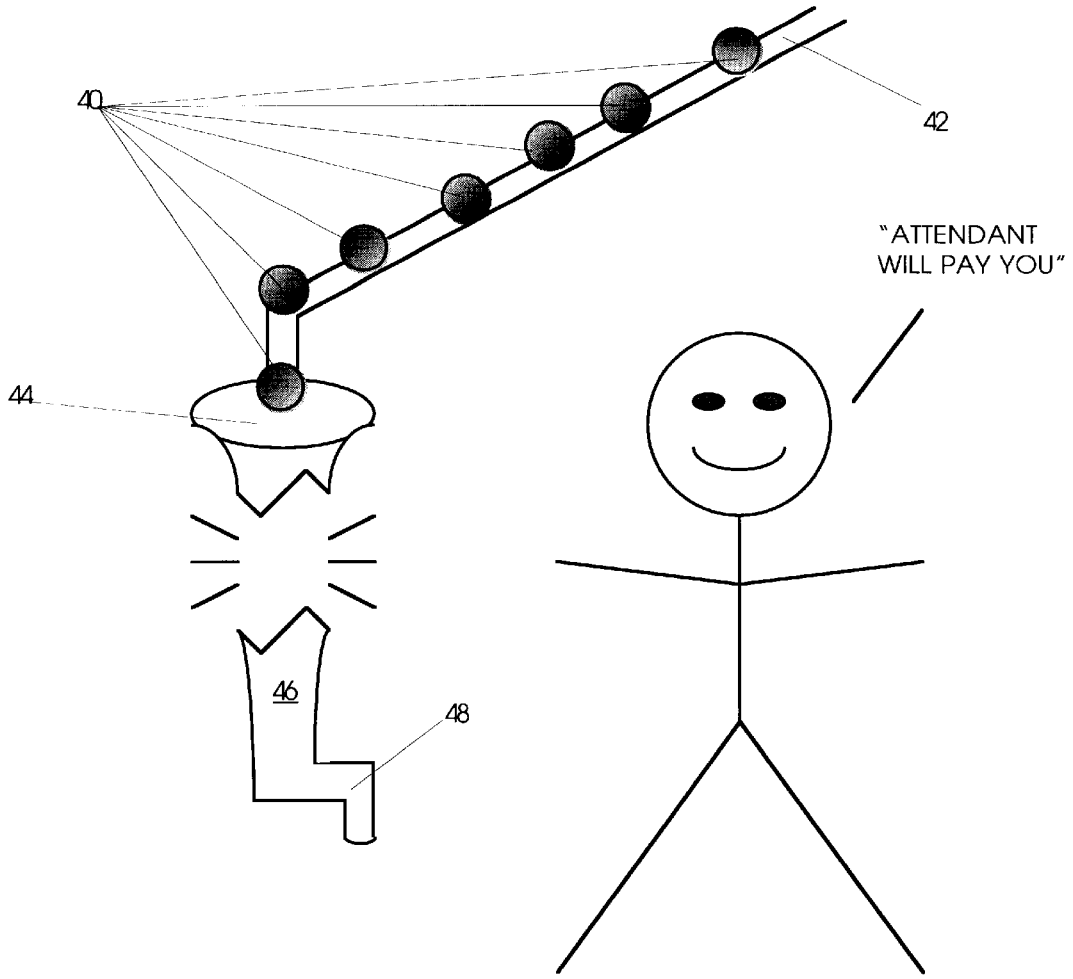
FIG. 1B is similar to FIG. 1A, but announces the payout of the grand prize to the player.
Figure 1B:
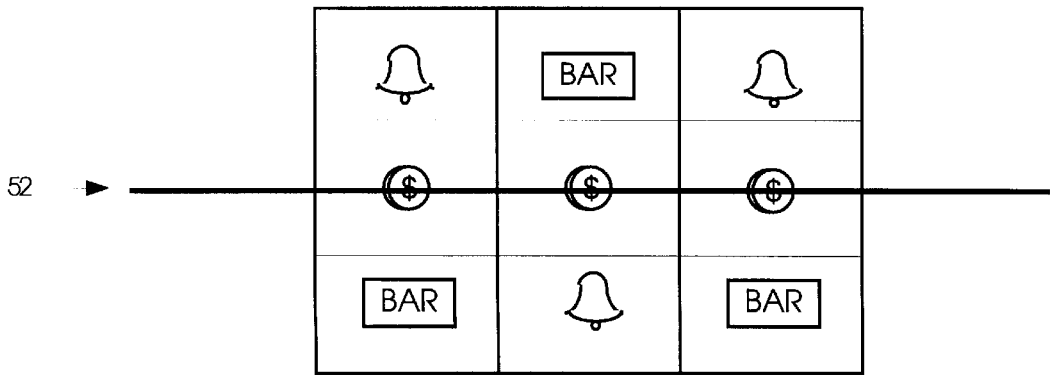
Figure 2:
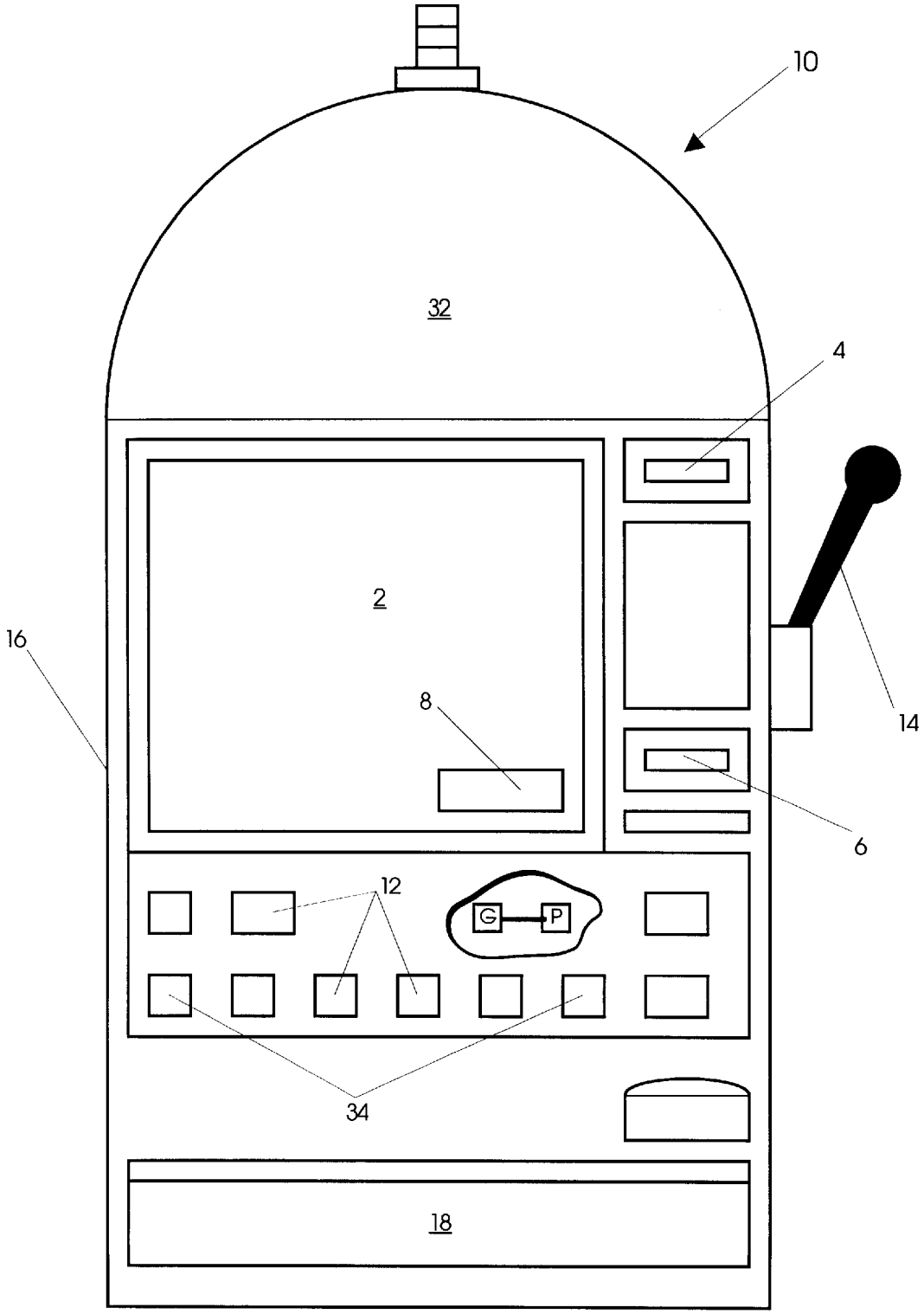
FIG. 2 is a visual depiction of a gaming machine adapted to be used in association with that which is shown in FIGS. 1A and 1B.
Figure 3:
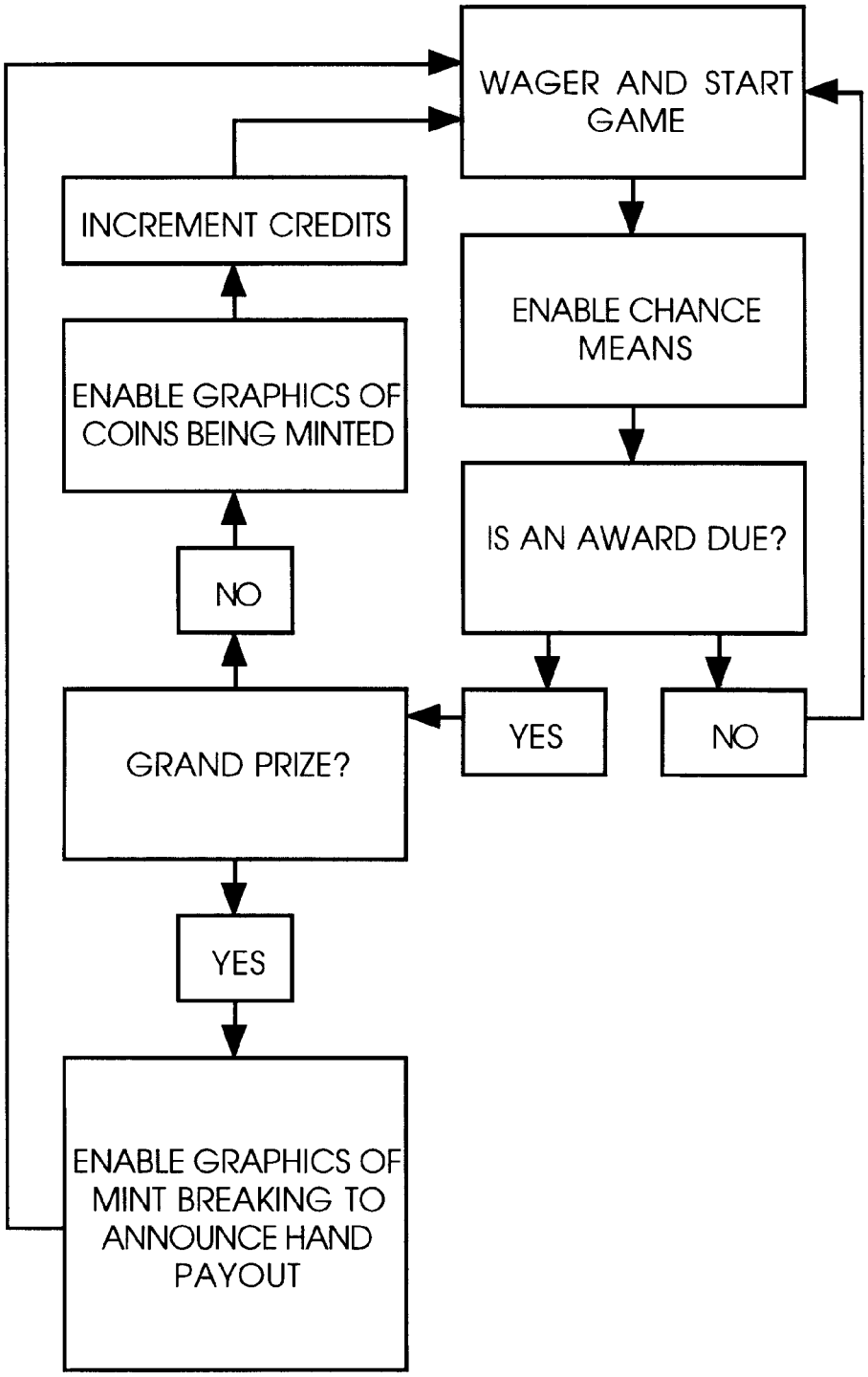
FIG. 3 is a flow chart of the game reflected in FIGS. 1A, 1B and 2.

Referring to FIG. 3, the sequence in which the game is played can be seen. First, the game is started by the inception of a wager by the player. Next, chance means are enabled which determines whether or not an award is due. If an award is not due, the player has the opportunity to restart the game and rewager. Alternatively, if an award is due, a decision must be made whether or not the grand prize is due and payable to the player. If the grand prize is not due and payable, the graphics mentioned above of the coins being minted appears on the display 2 and those credits correlative of the coins being minted are incremented to the counter associated with the player's wagering activity to his benefit. Should, however, a grand prize be due, then the graphics of FIG. 1B are enabled of the mint station being broken and the caricature announces the need of an attendant for the hand payout. This hand payout may supplement or be in lieu of increments being provided on the credit meter.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A gaming machine, comprising, in combination:

a video display operatively coupled to a processor;

a trackway depicted on said video display;

a minting station depicted on said video display including an inlet and an outlet;

said trackway having an end leading into said minting station inlet;

a plurality of balls depicted on said video display located on said trackway;

chance means for advancing said balls into said minting station;

coins depicted on said video display emanating from said minting station outlet; and means to increment credits to a player as a function of said chance means.

2. The gaming machine of claim 1 including an icon caricature contemporaneously depicted on said video display, and said minting station depicted as being broken concurrent with a grand prize to be awarded, and means to convey to the player of a hand payout.

3. The gaming machine of claim 2 wherein said chance means includes a payline which determines a payoff simulated by operation of said minting station.

4. A method for stimulating a player via a display monitor of a gaming machine, the steps including:

allowing the player to utilize chance means, displaying a plurality of balls rolling along a trackway and into a hopper of a minting station as a function of the chance means and displaying coins exiting the minting station as a function of player performance, and crediting the player with an award.

5. The method of claim 4 including simulating breaking the minting station upon the player having won a grand prize and displaying a caricature notifying the player of a hand payout.

* * * * *